US007849576B2

(12) United States Patent
Sawada et al.

(10) Patent No.: US 7,849,576 B2
(45) Date of Patent: Dec. 14, 2010

(54) SLIDE FASTENER MANUFACTURING APPARATUS

(75) Inventors: Toshiaki Sawada, Toyama (JP); Makoto Yamazaki, Toyama (JP)

(73) Assignee: YKK Corporation, Tokyo (JP)

( * ) Notice: Subject to any disclaimer, the term of this patent is extended or adjusted under 35 U.S.C. 154(b) by 1280 days.

(21) Appl. No.: 11/404,005

(22) Filed: Apr. 13, 2006

(65) Prior Publication Data

US 2006/0242815 A1 Nov. 2, 2006

(30) Foreign Application Priority Data

Apr. 28, 2005 (JP) ..... P2005-130775

(51) Int. Cl.
*B29D 5/00* (2006.01)

(52) U.S. Cl. ..... 29/408; 29/33.2; 29/410; 29/766

(58) Field of Classification Search ..... 29/408, 29/410, 33.2, 766
See application file for complete search history.

(56) References Cited

U.S. PATENT DOCUMENTS 4,369,560 A * 1/1983 Ueda ..... 29/408
4,459,884 A 7/1984 Yoshida et al.
4,520,544 A 6/1985 Morita et al.
4,594,925 A 6/1986 Ishikawa
4,624,369 A 11/1986 Okada
5,454,285 A 10/1995 Ishikawa et al.

FOREIGN PATENT DOCUMENTS

| | | |
|---|---|---|
| GB | 2167122 | 5/1986 |
| JP | A-50-113340 | 9/1975 |
| JP | 1-19890 | 4/1989 |

OTHER PUBLICATIONS

Japanese Office Action dated Jun. 2, 2009 for the corresponding JP Application No. 2005-130775.

* cited by examiner

*Primary Examiner*—Rick K Chang
(74) *Attorney, Agent, or Firm*—Alston & Bird LLP

(57) ABSTRACT

An apparatus and method for manufacturing a slide fastener. The apparatus may provide a chain transfer path inclined downward for transferring a fastener chain, a chain cutting portion disposed at a middle of the transfer path and a feed portion disposed on an upstream side of the chain cutting portion of the chain transfer path. A control portion may also be provided for a) stopping to transfer the fastener chain by the feed portion and b) operating the chain cutting portion. A pivoting section may also be provided, which pivots the chain cutting portion by a predetermined angle on the chain transfer path around an axis line orthogonal to the transfer path.

8 Claims, 8 Drawing Sheets

SLIDE FASTENER MANUFACTURING APPARATUS

BACKGROUND OF THE INVENTION

1. Field of the Invention

The present invention relates to a method and an apparatus of manufacturing a slide fastener, specifically to a method and an apparatus of successively manufacturing slide fasteners of the same length by successively cutting a long fastener chain, which is alternately arranged with fastener element rows and interval portions lacking the element rows in a longitudinal direction, at centers of the respective interval portions. The invention particularly relates to a method of successively manufacturing a slide fastener and its apparatus preferable for successively manufacturing a slide fastener from a fastener chain previously attached with a fly for jeans.

2. Description of the Related Art

In a related art, a slide fastener is successively manufactured by cutting a long fastener chain at each interval portion lacking a fastener element row. An example of a specific manufacturing technology is disclosed in, for example, JP-B-1-19890. According to this publication, transfer of the fastener chain transferred by transfer means is stopped when the interval portion reaches a cutting position for cutting means. The transfer means includes a pair of upper and lower transfer rolls and is arranged at a middle of a horizontal transfer path of the fastener chain. The cutting means includes upper and lower cooperatively moved cutting blades arranged at a discharge end of the transfer path. When transfer of the fastener chain is stopped, the upper cutting blade is moved down to cut the interval portion of the fastener chain in a crossing direction to successively cut to separate the slide fastener having a constant length from the fastener chain. The cut and separated slide fastener is dropped downward and is collected in a containing portion arranged on a lower side.

SUMMARY OF THE INVENTION

Meanwhile, according to the apparatus of manufacturing a slide fastener of this related art, as disclosed in JP-B-1-19890, it is general that the transfer path of the fastener chain is horizontal. Further, the transfer means is often arranged on an upstream side and a downstream side of the cutting means. In the case where, as in JP-B-1-19890, a transfer path for transferring the cut slide fastener cut by the cutting means is eliminated from the horizontal transfer path, a slide fastener portion of the fastener chain transferred frontward from the cutting means to be cut subsequently is folded to bend downward at a point of passing the cutting means. In this case, when cutting, there is a high possibility that a cut end of the slide fastener portion is cut in an inclined manner.

On the other hand, in the case where horizontal transfer paths are arranged frontward and rearward relative to the cutting means and also transfer means are arranged frontward and rearward relative to the cutting means, in cutting, tension forces are obliged to be asserted on the fastener chain. Thus, a difference in a cut length is easily produced.

Further, the cutting means is fixedly installed at an installing position on the horizontal transfer path. An upper end of the fly constituting a cloth piece in a short strip shape of, for example, jeans is frequently cut obliquely. Thus, a cutting apparatus exclusively used for obliquely cutting the fastener chain of jeans is fixedly disposed so as to obliquely cross the transfer path. At this occasion, a front end portion of the slide fastener portion to be cut next time is formed with a cut end portion inclined in a direction reverse to that of the preceding slide fastener. The slide fastener cut obliquely in the reverse direction does not constitute a product and therefore, the oblique cut end portion needs to be cut off again by another cutting apparatus.

The invention has been carried out in order to resolve the problem and it is an object thereof to provide a method and an apparatus of successively manufacturing a slide fastener having a cutting apparatus capable of cutting without applying unnecessary tension to a chain cut portion and without bringing about a state of loosening a fastener chain in cutting the fastener chain, and capable of cutting a normal fastener chain, and a fastener chain for jeans attached with a plurality of flies in a short strip shape in a requested cut shape.

According to the invention, the drawback of the background art is eliminated, an element lacking interval portion of a continuous long fastener chain can be cut at any position thereof (for example, even at a vicinity of front ends of a pair of meshed elements), and a slide fastener can be manufactured firmly, uniformly and with proper quality without damaging or expanding to open frontmost meshed elements, or damaging a lower stop piece of a front end portion thereof.

The above-described object is achieved by a method of manufacturing a slide fastener by cutting a long fastener chain alternately having in a longitudinal direction thereof a pair of element rows meshing with each other and an interval portion lacking the element row at a predetermined position of the interval portion, the method including the steps of: arranging a feed portion of the fastener chain on an upstream side of a chain cutting portion; positively transferring the fastener chain successively by the feed portion to the chain cutting portion along an inclined transfer path inclined downward; operating the chain cutting portion after awaiting for stopping to transfer the fastener chain and cutting the slide faster chain in a cross direction at the predetermined position of the interval portion; and making the slide fastener cut to be separated by the chain cutting portion slide down by a self weight thereof along the transfer path.

When a fastener chain attached with a fly, in which short cloth pieces contiguous end portions of which are arranged at a constant interval are successively attached to the slide fastener chain over a longitudinal direction thereof is cut on the interval portion of the fastener chain, the method includes the step of pivoting the cutting portion by a predetermined angle around an axis line orthogonal to the inclined transfer path by means of pivoting the cutting portion, thereafter, skewedly crossing to cut the fastener chain at the predetermined position of the interval portion by operating the cutting portion.

Further, it is preferable that the method further includes the steps of moving forward the fastener chain by a predetermined length by operating the feed portion, thereafter, pivoting the cutting portion in a direction of orthogonally crossing the transfer path, operating the cutting section and cutting off a front end inclined portion of the fastener chain.

There may be constructed a constitution in which the slide fastener sliding down by the self weight on the transfer path and falling at an end of the transfer path is temporarily placed on a slide fastener receiving portion having a downward inclination angle smaller than an inclination angle of a downward inclination of the transfer path, thereafter, made to fall to be contained in a containing portion arranged on a lower side of the receiving portion.

Such a manufacturing method is effectively realized by a slide fastener manufacturing apparatus for manufacturing a slide fastener by cutting a long fastener chain alternately having in a longitudinal direction thereof a pair of element rows meshing with each other and an interval portion lacking the element row at a predetermined position of the interval portion, the apparatus including: a chain transfer path inclined downward for transferring the fastener chain; a chain cutting portion disposed at a middle of the transfer path; a feed portion of the fastener chain disposed on an upstream side of the chain cutting portion of the chain transfer path; and a control portion for stopping to transfer the fastener chain by the feed portion and operating the chain cutting portion.

Preferably, the apparatus further includes a pivoting section for pivoting the cutting portion by a predetermined angle on the transfer path of the fastener chain around an axis line orthogonal to the transfer path, and includes a slide fastener receiving portion arranged on a lower side of a slide fastener discharge end of the transfer path and having a bottom portion having an inclination angle smaller than an inclination angle of the transfer path. It is preferable that a bottom portion of the slide fastener receiving portion is made to be able to be opened and closed by opening and closing section for opening and closing the bottom portion and the apparatus may include a containing portion for containing the slide fastener fell by a self weight thereof in opening the bottom portions on a lower side of the bottom portions. At this occasion, it is preferable that the containing portion includes a plurality of containing chambers partitioned along an outer peripheral portion of a rotating table. The apparatus includes a control portion for automatically operating various operating members of the length measuring section, the cutting portion, the pivoting section, the opening and closing section, the bottom portion of the slide fastener receiving portion, means for rotating the containing portion and the like successively in accordance with a previously determined procedure.

The transferring section is arranged on the upstream side of the cutting portion, the front end portion of the fastener chain is transferred by exceeding the cutting portion by a required length and the fastener chain is stopped to transfer. At this occasion, the fastener chain is transferred smoothly along the transfer path inclined downwardly by being assisted by the self weight. In order to stop the transfer by the transferring section, the front end or the rear end of the interval portion to be cut at a successive time of the fastener chain is detected by the detecting section arranged at the middle of the transfer path, and the detecting signal is transmitted to the length measuring section. At the length measuring section, the length is started to measure by receiving the detecting signal, and when the value of the measured length reaches a previously set value, the transferring section is stopped to be operated and the fastener chain is stopped to be transferred.

At this occasion, the interval portion constituting an object of cutting the fastener chain is disposed at the cutting position of the cutting portion. When the transferring section is stopped to operate, the cutting portion is operated to cut the interval portion in the cross direction to cut to separate the fastener chain and the slide fastener. In the cutting operation, at an interval between a position at which the fastener chain is grabbed by the transferring section of the fastener chain and a position of a front free end thereof, the self weight along the inclined transfer path is worked, the fastener chain is brought into a state in which the faster chain is not under an extreme tension and is not slacked and therefore, the fastener chain can be cut always at a constant length. Here, the slide fastener cut to be separated slides down by its own weight along the inclined transfer path inclined downward. At this occasion, a particular power for transferring the slide fastener is not needed.

According to the invention, it is preferable to provide pivoting section for arbitrarily pivoting the cutting portion by a required angle on the path of transferring the fastener chain and around an axis line orthogonal to the transfer path. In a case of a general fastener chain, fastener element rows of simply two pieces of fastener stringers opposed to each other are brought into a meshed state to constitute the fastener chain. Although in the case of the fastener chain having the normal structure, a center of the interval portion is cut orthogonally to the fastener chain in the cross direction, for example, in a case of a fastener chain attached with the fly one end of which is skewedly cut as in, for example, a fly of jeans, a cutting apparatus exclusive for jeans for skewedly cutting is needed.

When there is provided the pivoting section for arbitrarily pivoting the cutting portion by the required angle on the path of transferring the fastener chain and around the axis line orthogonal to the transfer path, in cutting the normal fastener chain, the cutting portion can be set to cut the fastener chain by orthogonally crossing the transfer path, or when the fastener chain attached with the fly which is attached with the fly of jeans is skewedly cut, after pivoting the cutting portion to set a cutting blade thereof in a direction of skewedly crossing the transfer path, the fastener chain can skewedly be cut.

Further, according to the invention, it is preferable to receive a slide fastener sliding down on the inclined transfer path by the self weight in this way temporarily by a slide fastener receiving portion. By receiving the slide fastener by a bottom portion of the slide fastener receiving portion, a mode of falling of the slide fastener is not deteriorated. Particularly, by making an inclination angle of the bottom portion of the receiving portion smaller than the inclination angle of the inclined transfer path, the slide fastener can be received in a state of further maintaining the falling mode. Further, by making the bottom portion of the slide fastener receiving portion openable and closable and opening the bottom portion, the slide fastener received by the bottom portion is contained to the containing portion on the lower side by the self weight. At this occasion, the inclination angle of the bottom portion is set to the inclination angle proximate to horizontal and therefore, even when the slide fastener is made to fall to the containing portion by opening the receiving portion, a directionality of the slide fastener remains unchanged when contained in the containing portion and the slide fastener is contained in a regulated state.

When the containing portion includes a plurality of containing chambers partitioned along an outer peripheral edge portion of a rotating table, the rotating table is automatically rotated when a number of sheets of the slide fasteners contained in the containing chamber becomes a predetermined number of sheets and the slide fastener is contained in the containing chamber at a next position.

DETAILED DESCRIPTION OF THE PREFERRED EMBODIMENTS

Figure 1:
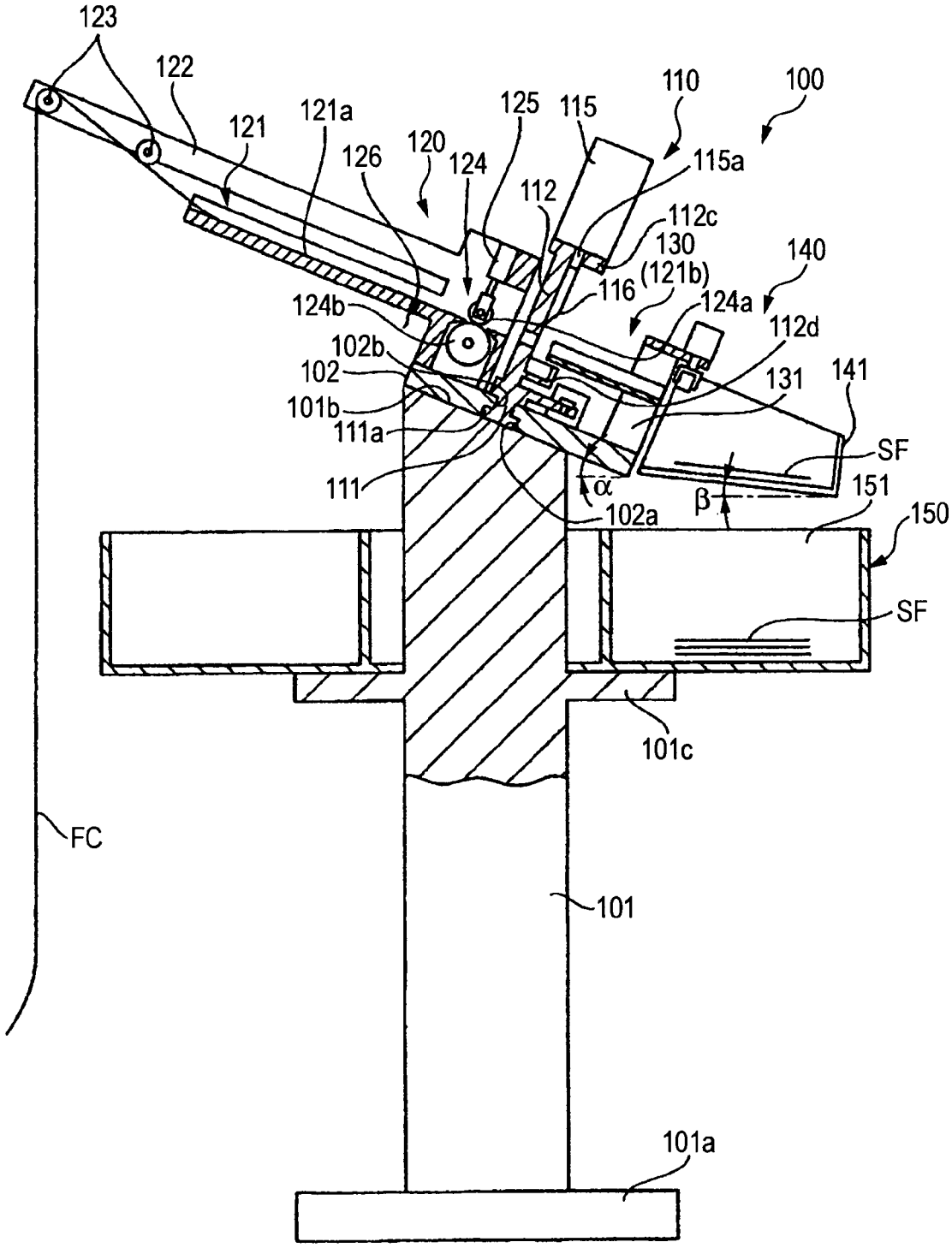
FIG. 1 is a partially cut away side view showing the whole constitution of a successive manufacturing apparatus of a slide fastener according to a first embodiment of the invention.

A detailed explanation will be given of the invention based on a representative embodiment shown in the drawings.

According to the invention, a continuous long fastener chain FC is successively cut to slide fasteners SF having the same length. A long fastener chain FC has a pair of continuous stringers. Fastener element rows ER are attached along opposed side edges of fastener tapes T of the pair of stringers. The fastener chain FC is constituted by bringing the fastener element row ER on one side in mesh with a corresponding element E of the fastener element row ER opposed thereto. Further, the continuous fastener element row ER is formed with interval portions S lacking the element row ER at predetermined intervals. That is, the fastener chain FC is formed with the fastener element rows ER having a constant length and the interval portions S lacking the fastener element row ER alternately in a length direction. Front and rear ends of each interval portion S are attached with an upper stop piece and a lower stop piece, not illustrated, at a preceding step. Also, a slider, not illustrated, is inserted through the fastener element row ER between the upper stop piece and the lower stop piece.

FIG. 1 is a partially cut away side view showing a representative embodiment of a successive manufacturing apparatus 100 of a slide fastener according to the invention. A stay 101 is erected at a floor face by way of a seat portion 101*a*. An upper face of the stay 101 is inclined downward in one direction by a predetermined inclination angle $\alpha$ and an inclined face 101*b* thereof is fixedly provided with a board 102 inclined downward from one end of the inclined face 101*b* by the same inclination angle $\alpha$ and extending a lower end portion thereof. Substantially a center portion of the inclined face 101*b* is provided with a chain cutting portion 110 of the fastener chain FC orthogonally to the inclined face 101*b*. Further, a chain transfer portion 120 for transferring the fastener chain FC to the chain cutting portion 110, a fastener slide down portion 130 for sliding down the slide fastener SF cut by the chain cutting portion 110 and separated from the fastener chain FC, and a discharging portion 140 for discharging the slide fastener SF. The chain cutting portion 110 is interposed between the chain transfer portion and the fastener slide down portion.

Figure 3:
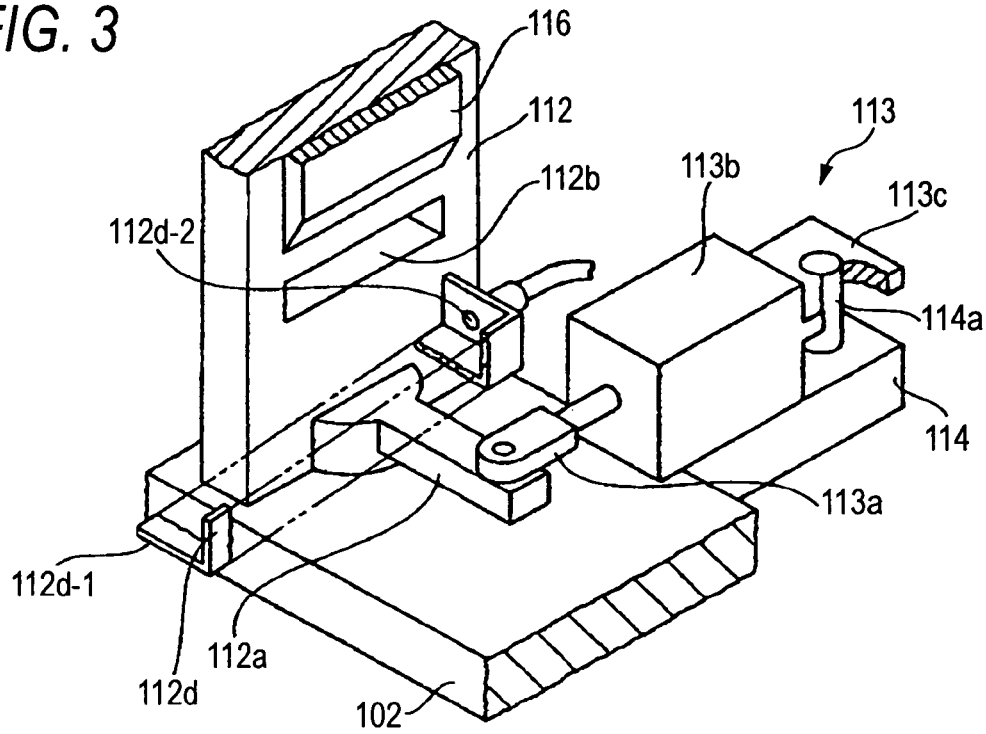
FIG. 3 is a perspective view of an essential portion showing an example of an angle adjusting mechanism of the cutting portion of the apparatus.

A center of a lower end portion of the chain cutting portion 110 includes a rotating shaft portion 111 pivotable around an axis line orthogonal to an inclined face of the board 102. The rotating shaft portion 111 includes a flange 111*a* at a lower end thereof, the flange 111*a* is rotatably fitted to a large hole portion 102*a* formed on a lower face side of the board 102, and the rotating shaft portion 111 is inserted through a small hole portion 102*b* formed on an upper face side of the board 102. The rotating shaft portion 111 is provided with a length up to an upper opening end of the small hole portion 102*b*, an upper end of the shaft portion 111 includes a chain cutting portion main body 112 extended in an upper direction. The chain cutting portion main body 112 has a rectangular plate member, as shown in FIG. 3, at a center of a lower end portion thereof, an operating rod 112*a* for pivoting the chain cutting portion main body 112 along the upper face of the board 102 by way of the shaft portion 111 is extended to a fastener discharge end side in parallel with the upper face of the board 102. A front end of the operating rod 112*a* is axially attached with a rod end 113*a* of a cutting angle changing cylinder 113 constituting a pivoting section.

A main body 113*b* of the cutting angle changing cylinder 113 is mounted to a mounting base 114 extended from one side face in a transverse direction of the board 102. A rear end portion of the cutting angle changing cylinder main body 113*b* includes an axially attaching portion 113*c* and the axially attaching portion 113*c* is pivotably supported by a pin 114*a* projected from the mounting base 114. A center portion of the chain cutting portion main body 112 having a rectangular plate member is penetrated to be formed with a fastener chain inserting hole 112*b* in a transversely prolonged rectangular shape along a direction of inclining the board 102. Further, an upper end of the chain cutting portion main body 112 is fixedly provided with an mounting base 112*c* mounted with a cutting cylinder 115 as shown in FIG. 1. A piston rod 115*a* extended to a lower side of the cutting cylinder 115 is exposed to the lower side from a lower face of the mounting base 112*c* by passing a rod inserting hole formed in the mounting base 112*c*. A rod end of the piston rod 115*a* is fixedly provided integrally with a cutting blade 116 to be brought into sliding contact with a front face (right side of FIG. 1) of the chain cutting portion main body 112.

Figure 4:
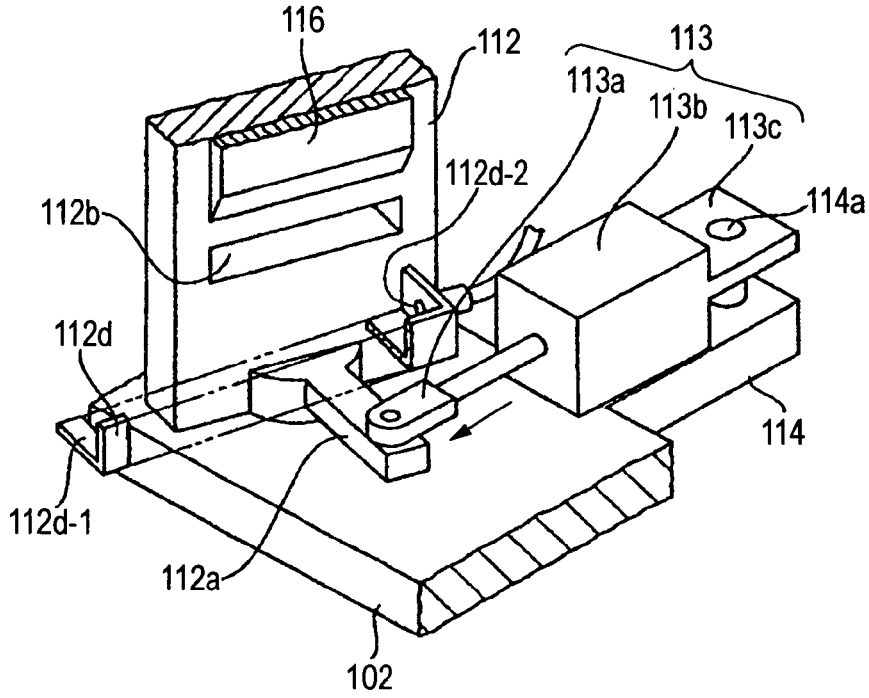
FIG. 4 is a perspective view of an essential portion showing the cutting portion when a cutting angle of the cutting portion is changed by the angle adjusting mechanism.

Further, a cut chip discharge portion 112*d* in a shape of a veranda is projected at the front face (right side of FIG. 1) of the chain cutting portion main body 112 and right below the fastener chain inserting hole 112*b*. As shown in FIG. 3 and FIG. 4, the cut chip discharge portion 112*d* is closed at one end of a discharge path 112*d*-1 and opened at the other end thereof to constitute a cut chip discharge port. As shown in FIG. 3, the closed end is formed with an air blow out port 112*d*-2 for blowing out compressed air to the discharge path 112*d*-1 of the cut chip. The air blow out port 112*d*-2 is connected to a supply source of compressed air by way of a pipe.

The chain transfer portion 120 arranged at the upper face of the board 102 on a rear face side (left side of FIG. 1) of the chain cutting portion 110 is unitized and is provided with a chain transfer path 121 (upstream side chain transfer path 121*a*) linearly extended to the chain cutting portion 110, a plurality of chain guide rollers 123 rotatably supported by a bracket 122 arranged on an upper side of the chain transfer path 121*a* and extended to a rear side further from a rear end of the chain transfer path 121*a*, a pair of upper and lower feed rollers 124 arranged at a portion of the chain transfer path 121 contiguous to a rear face side of the chain cutting portion 110, and a chain interval portion detecting section 126 arranged at the chain transfer path 121*a* on a side of the guide roller relative to the feed rollers.

The chain transfer path 121*a* is also inclined downward by the inclination angle α, and a transfer face at a front end (right end of FIG. 1) is arranged on a plane the same as that of a guide face of the fastener chain inserting hole 112*b* formed to be prolonged transversely at the center portion of the chain cutting portion main body 112. The bracket 122 is extended in a skewed upper direction in parallel with the chain transfer path 121*a*. The chain guide roller 123 is supported in a cantilever shape at a position of the bracket 122 rearward from a rear end of the fastener chain inserting hole 112*b* and on a skewed upper side for guiding the fastener chain FC fed vertically from a lower side to be fed in a skewed downward direction. The fastener chain FC guided by the chain guide roller 123 is positively supplied frontward to the chain cutting portion 110 on the chain transfer path 121*a* by the feed roller 124.

Figure 2:
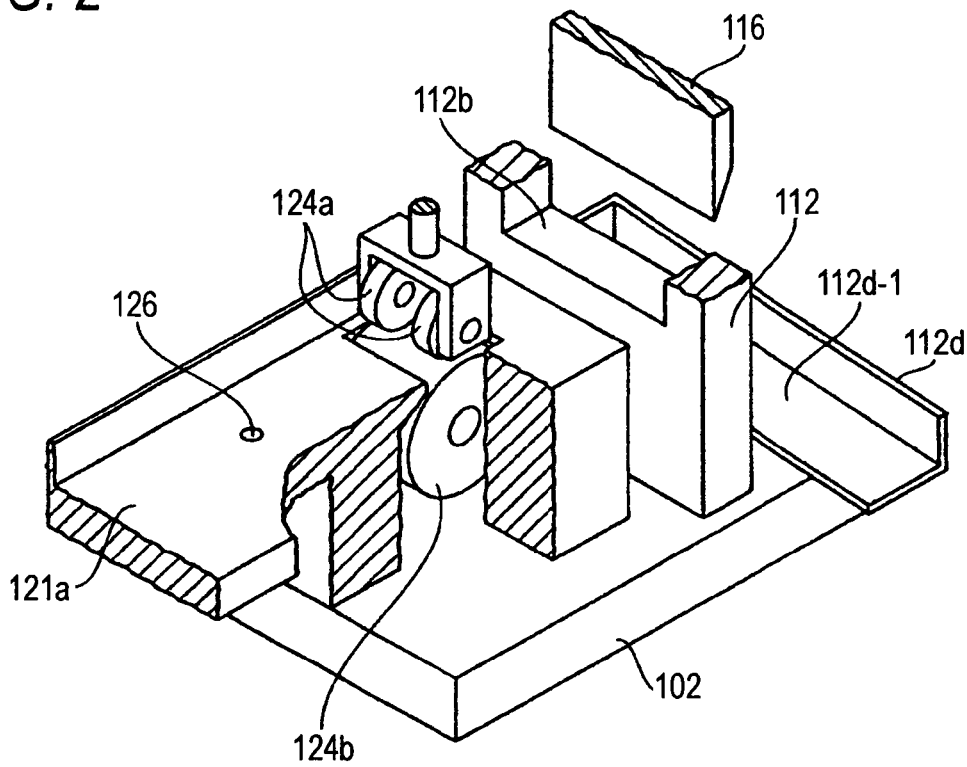
FIG. 2 is an enlarged perspective view showing essential portions of a chain transfer portion and a cutting portion of the successive manufacturing apparatus.

As shown in FIG. 2, a pair of left and right upper rollers 124*a* in the feed roller 124 are constituted to respectively press tape portions arranged on left and right sides of the fastener element row ER of the fastener chain FC. A rotating shaft of the upper roller 124*a* is rotatably supported by the rod end of the pressing cylinder 125 by way of an elastic member of a spring or the like. In manufacturing the slide fastener, normally, the pressing cylinder 125 is elongated, and a peripheral face of a lower roller 124*b* is pressed by an elastic force of the elastic member. When the fastener chain FC is mounted to the successive manufacturing apparatus 100 or detached therefrom, the pressing cylinder 125 is operated in a length contracting direction, and the upper roller 124*a* is separated from the peripheral face of the lower roller 124*b*. The upper roller 124*a* is a freely rotated roller and the lower roller 124*b* is a drive roller positively driven by a drive source having a servo motor or the like.

The chain interval portion detecting section 126 is a proximity switch arranged to be exposed to the transfer face of the chain transfer path 121*a* for detecting presence or absence of the interval portion S from a rear face side of the fastener chain. Further, the detecting section 126 may be arranged on an upper side of the chain transfer path 121*a*, further, may be photoelectric switches arranged on upper and lower sides which interpose the chain transfer path 121*a*.

Figure 5:
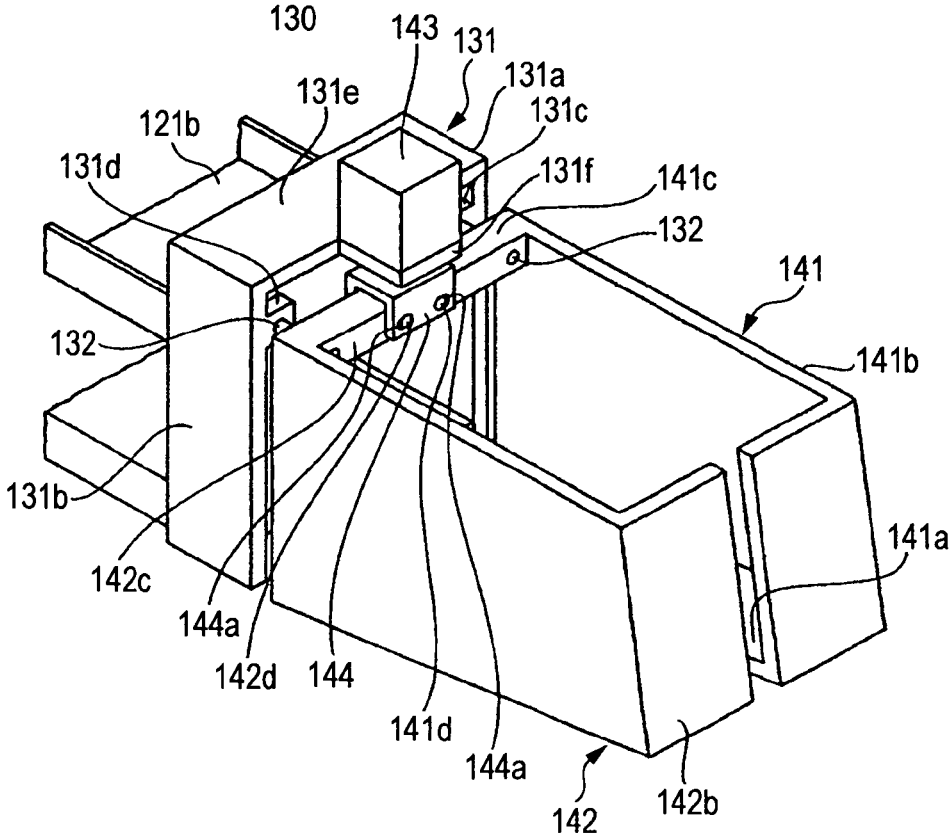
FIG. 5 is a perspective view showing examples of structures of a fastener slide down portion and a fastener discharging portion of the apparatus.

According to the embodiment, the fastener slide down portion 130 (downstream side chain transfer path 121*b*) and the discharge portion 140 of the slide fastener SF are unitized. However, the fastener slide down portion 130 and the discharge portion 140 can be constituted separately from each other by respectively independent constituent members similar to the chain transfer portion 121. As shown in FIG. 1, the fastener slide down portion 130 is formed in a shape of a trough having a section in a recess shape. The fastener slide down portion 130 has a width of the slide fastener SF cut by the chain cutting portion 110 and cut to be separated from the fastener chain FC. As shown in FIG. 5, a front end portion of the fastener slide down portion 130 is to a frame 131 in a gate shape a lower end portion of which is fixed to side faces in a width direction of the board 102. A bottom face of a rear end portion of the fastener slide down portion 130 is fixed such that a height of the bottom face becomes equal to or lower than the chain guide face of the fastener chain inserting hole 112*b* formed at the main body 112 of the chain cutting portion 110. Also, the fastener slide down portion 130 is inclined downward by the inclination angle α from a rear end over to a front end thereof similar to the chain cutting portion 110 and the chain transfer portion 120. The downstream side chain transfer path 121*b* of the slide down portion 130 and the upstream side chain transfer path 121*a* form the chain transfer path 121.

Figure 6:
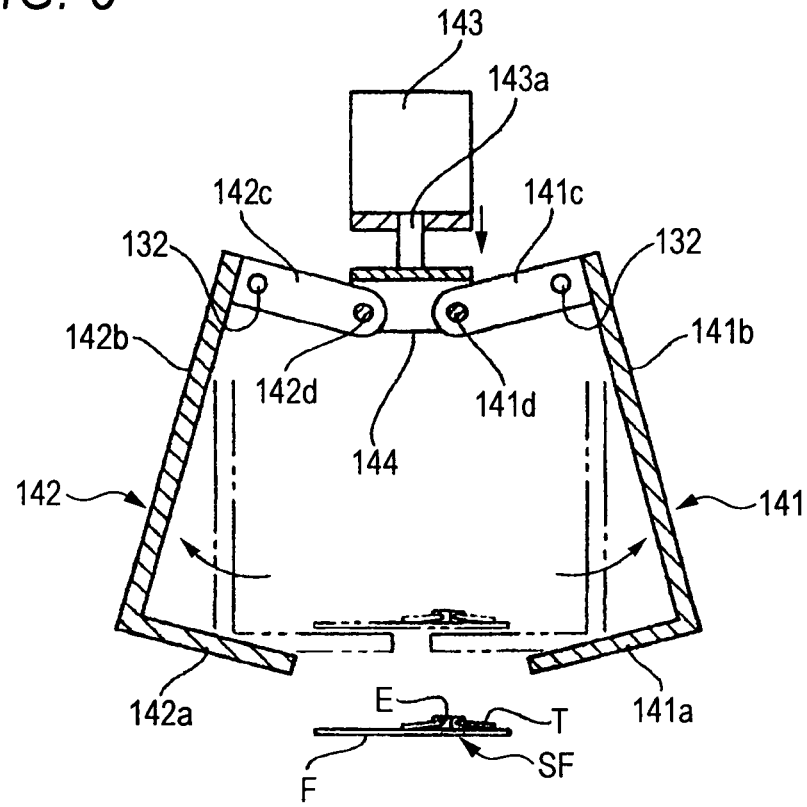
FIG. 6 is a cross-sectional view showing an example of a discharging mechanism of the fastener discharging portion.

As shown in FIG. 5, upper inner wall faces of left and right column portions 131*a*, 131*b* of the frame 131 in the gate shape are provided with a pair of the support shaft fixing portions 131*c*, 131*d*. A pair of left and right pivoting members 141, 142 which are constituent members of the fastener receiving and discharging portion 140 are pivotably supported by a pair of left and right support shafts 132 projected to the front side. As shown in FIG. 5 and FIG. 6, the left and right pivoting members 141, 142 are provided with a structure symmetrical in a left and right direction. The respective pivoting members 141, 142 are provided with respective bottom portions 141*a*, 142*a* having square plate members, a pair of left and right side wall portions 141*b*, 142*b* formed in an L-like shape from outer side edges extended in a front and rear direction of the bottom portions 141*a*, 142*a* over to front end edges thereof, and operating rods 141*c*, 142*c* extended from upper ends of rear end opening portions of the left and right side wall portions 141*b*, 142*b* orthogonally in directions of being proximate to each other. Proximate side end portions of the left and right operating rods 141*c*, 142*c* are projected with shaft portions 141*d*, 142*d* in a front and rear direction of the operating rods 141*c*, 142*c*. The shaft portions 141*d*, 142*d* are in parallel with the support shafts 132 projected from the gate shape frame 131.

Meanwhile, a center portion of an upper end beam portion 131*e* of the gate shape frame 131 is projected with a shelf portion 131*f* for mounting and fixing a pivoting member operating cylinder 142 for pivoting the left and right pivoting members 141, 142 to direct to a front side. A piston rod 143*a* of the pivoting member operating cylinder 143 is projected downward by passing a rod inserting hole formed in the shelf portion 131*f*, and a roe end thereof is fixed to a connecting member 144 that pivotably supports the pivoting members 141, 142. As shown in FIG. 5, the connecting member 144 has an inversely recessed shape member communicated in a left and right direction, and front end portions of the respective operating rods 141*c*, 142*c* of the pair of left and right pivoting members 141, 142 are inserted to be fitted thereto from left and right sides. Further, the connecting member 144 is formed with a pair of left and right shaft portions supporting long holes 144*a* for supporting the respective shaft portions 141*d*, 142*d* provided at the front ends of the left and right operating rods 141*c*, 142*c* and projected in the front and rear direction pivotably and slidably in a horizontal direction to penetrate in the front and rear direction.

When the left and right pivoting members 141, 142 are brought into a closed state, fastener receiving faces of the bottom portions 141*a*, 142*a* are inclined by an inclination angle β proximate to be horizontal more than the inclination angle α of the chain cutting portion 110, the chain transfer portion 120 and the fastener slide down portion 130. This is because when the inclination angle β is constituted by an inclination angle the same as the inclination angle α of the chain cutting portion 110, the chain transfer portion 120 and the fastener slide down portion 130, in a case in which the left and right pivoting members 141, 142 are opened and the slide fastener SF falls freely, an attitude of falling down to the fastener containing portion 150 on the lower side is not determined. When the fastener receiving faces of the bottom portions 141*a*, 142*a* of the pivoting members 141, 142 are inclined by constituting the inclination angle β as described above, the slide fastener SF falls in the same attitude and is regulated to a predetermined position of the fastener containing portion 150 to be contained.

Figure 7:
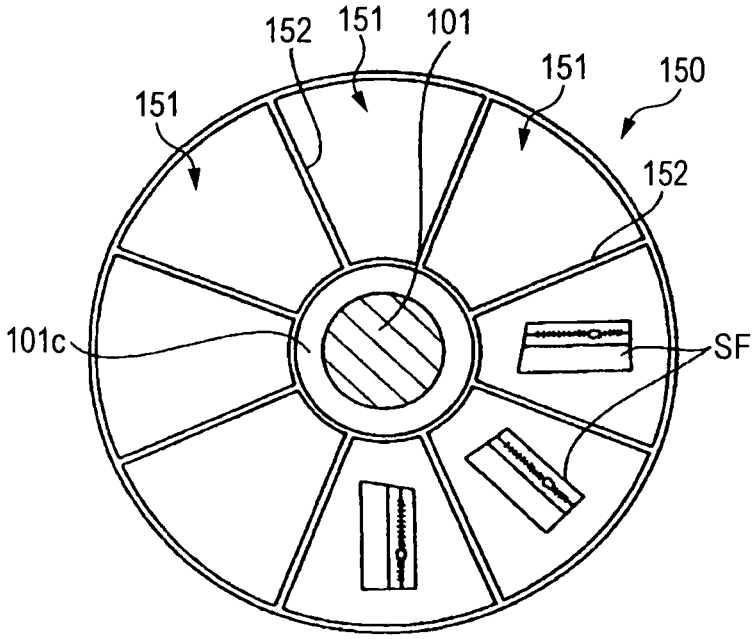
FIG. 7 is a top view of a fastener containing portion arranged on a lower side of the fastener discharging portion.

According to the invention, the slide fastener SF temporarily received by the bottom portions 141*a*, 142*a* of the left and right pivoting members 141, 142 freely falls by a self weight thereof by opening the bottom portions 141*a*, 142*a*. In order to contain the falling slide fastener SF, the slide fastener containing portion 150 is arranged right below the left and right pivoting members 141, 142. According to the embodiment, as shown in FIG. 1 and FIG. 7, a containing portion mounting flange 101*c* expanded in a diameter direction is provided at a middle portion of the stay 101, and the slide fastener containing portion 150 in a ring-like shape is supported by an upper face of the containing portion mounting flange 101*c* to be able to be rotated intermittently centering on the stay 101 by a publicly-known intermittently rotating mechanism of a ratchet mechanism or the like, not illustrated. The slide fastener containing portion 150 in the ring-like shape is partitioned to a plurality of containing chambers 151 in a peripheral direction. Positions of arranging the respective containing chambers 151 are disposed right below the bottom portions 141*a*, 142*a* of the left and right pivoting members 141, 142.

Figure 8:
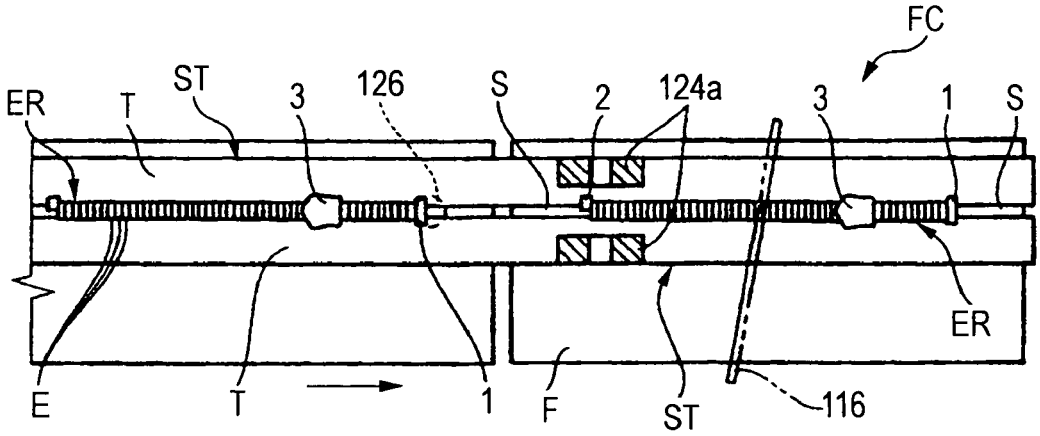
FIG. 8 is a top view showing a state of transferring a fastener chain.

Now, a detailed explanation will be given of operations of cutting the fastener chain FC according to the embodiment by a unit of the slide fastener to be contained in the containing portion in the above-described constitution. Further, in explaining an operational procedure described below, as the slide fastener SF, an object of processing is constituted by a fastener chain attached with a fly for jeans attached with a plurality of flies applied to a front opening portion of jeans at predetermined interval in a longitudinal direction. As shown in FIG. 8, the fastener chain FC attached with the fly for jeans adopted in the embodiment is attached to a portion of a fastener tape T contiguous to one sides of the fastener element rows by sewing or the like. The fastener tape T extends over the fastener element rows ER. The flies F are provided with predetermined intervals OP therebetween. The intervals OP are positioned between end portions of contiguous flies F at a center of each interval portion S lacking the fastener element row ER of a normal fastener chain main body.

The fly F may be attached deviatedly to one side in a width direction of the normal fastener chain main body and a front end corner portion in the transfer direction may be cut to be removed in a circular arc shape before being attached. In this kind of jeans, an upper end waist portion of the front opening portion is frequently formed to be inclined in a flat V-like shape in front view thereof. Therefore, when the fastener chain FC is cut at an end portion opposite to the inclined end of the fly F, it is necessary to cut the fastener chain FC to skewedly cross the chain transfer path 121. According to the successive manufacturing apparatus 100 of the slide fastener of the embodiment, the end portion inclined in this way can be formed. Naturally, regardless of whether the fly F is attached, the fastener chain FC can also be cut to orthogonally cross the chain transfer path 121.

Now, when the fastener chain FC attached with the fly is going to be cut skewedly as described above, as shown in FIG. 4, when the cutting angle changing cylinder 113 is operated in the elongating direction, the whole of the chain cutting portion main body 112 is pivoted on the board 102 centering on the rotating shaft portion 111 along with the cutting blade 116 by way of the operating rod 112*a* pivotably attached to the rod end 113*a*. Although the rotating angle at this occasion is set to 10°, the rotating angle can be adjusted arbitrarily in a range of 0° through 15°. After adjusting the cutting angle of the cutting portion 110 in this way, the fastener chain FC attached with the fly is transferred to the chain cutting portion 110 by driving the feed roller pair 124.

Figure 9:
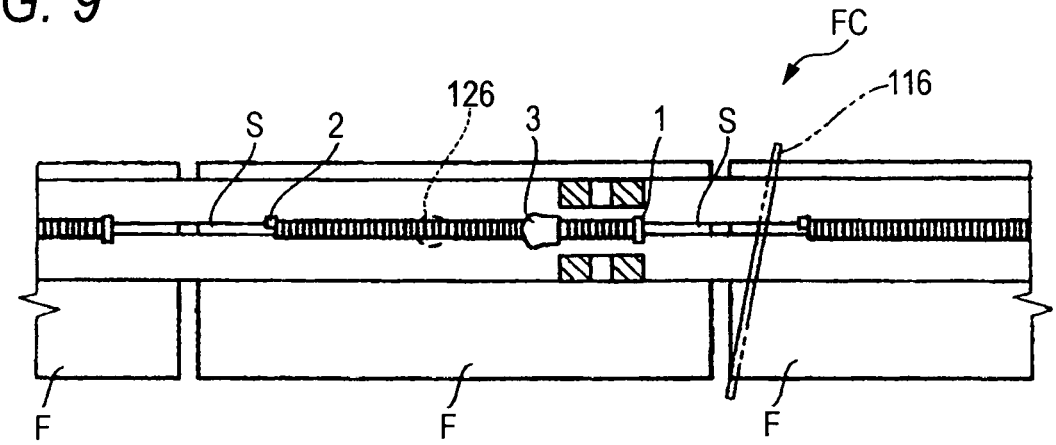
FIG. 9 is a top view showing a state where the transfer of the fastener chain is stopped.

In the midst of the transfer, as shown in FIG. 8, the interval portion S to be cut passes through a position detected by the chain interval end portion detecting section 126. A front end portion of the interval portion S is fixedly attached with an upper stop piece 2 and a rear end thereof is fixedly attached with a lower stop piece 1. In the embodiment, although the upper stop piece 2 is fixedly attached only to one fastener stringer ST, the upper stop piece 2 may be fixedly attached to the left and right fastener stringers ST to be opposed to each other. Further, when the interval portion S passes through the position detected by the chain interval end portion detecting section 126 of a noncontact type or a photoelectric type and the chain interval end portion detecting section 126 detects the lower stop piece 1 or the element E, a detecting signal is transmitted to, for example, a timer or a length measuring section for counting a revolution number of the lower roller 124*b* constituting the drive roller of the feed roller pair 124, not illustrated. A previously set transfer distance is measured by the measuring section and when the set transfer distance is reached, the measuring signal is transmitted to a control portion, not illustrated, a drive stop signal of a servo motor, not illustrated, constituting the drive source of the lower roller 124*b* is issued from the control portion to immediately stop rotation the lower roller 124 to stop transferring the fastener chain FC with a fly in a state shown in FIG. 9.

Incidentally, even when the fly F is not attached to the fastener chain FC, the lower stop piece or the element E fixedly attached to the rear end of the interval portion S is detected, and thereafter, a length is started to be measured and at a time point of reaching the set transfer distance, the fastener chain FC is stopped.

Figure 10:
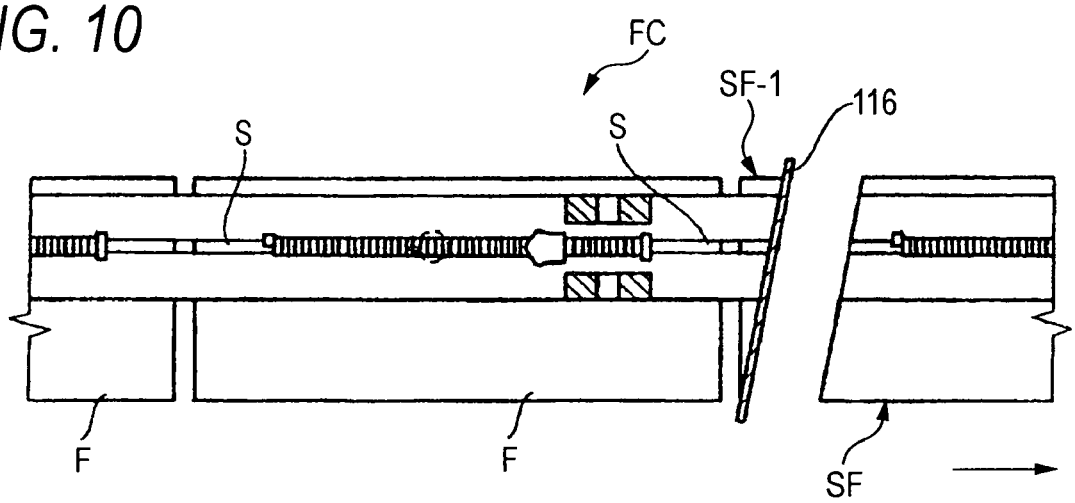
FIG. 10 is a top view of the fastener chain skewedly cut by a cutter of the cutting portion and the slide fastener which is cut to be separated.

The chain cutting cylinder 115 is operated simultaneously with stopping of the fastener chain FC attached with the fly. As shown in FIG. 10, the chain cutting blade 116 is moved down and skewedly cut the fastener chain FC attached with the fly passing the chain inserting hole 112*b* along with the fly F between the chain cutting blade 116 and the cutting portion main body 112 to cut to separate the slide fastener SF attached with the fly. The slide fastener SF attached with the fly which has been cut to be separated slide down to the fastener receiving portion 140 by the self weight on the inclined face of the fastener slide down portion 130. During a time period of sliding down, the chain cutting cylinder 115 returns to the original standby position, and the cutting angle changing cylinder 113 is operated in the length contracting direction to make the pivoting angle of the chain cutting portion main body 112 0°.

Figure 11:
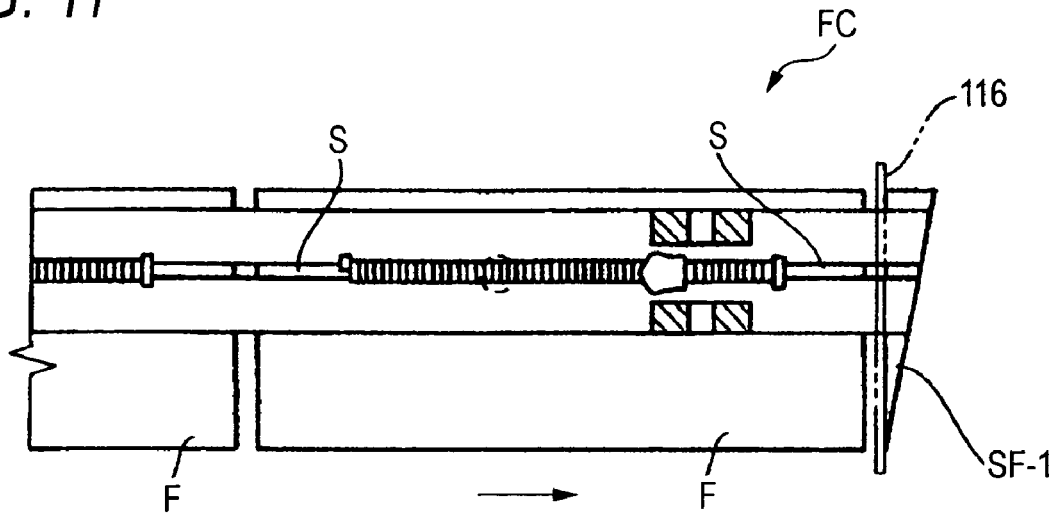
FIG. 11 is a top view showing a position of cutting to remove an uncut end of the fastener chain.
Figure 12:
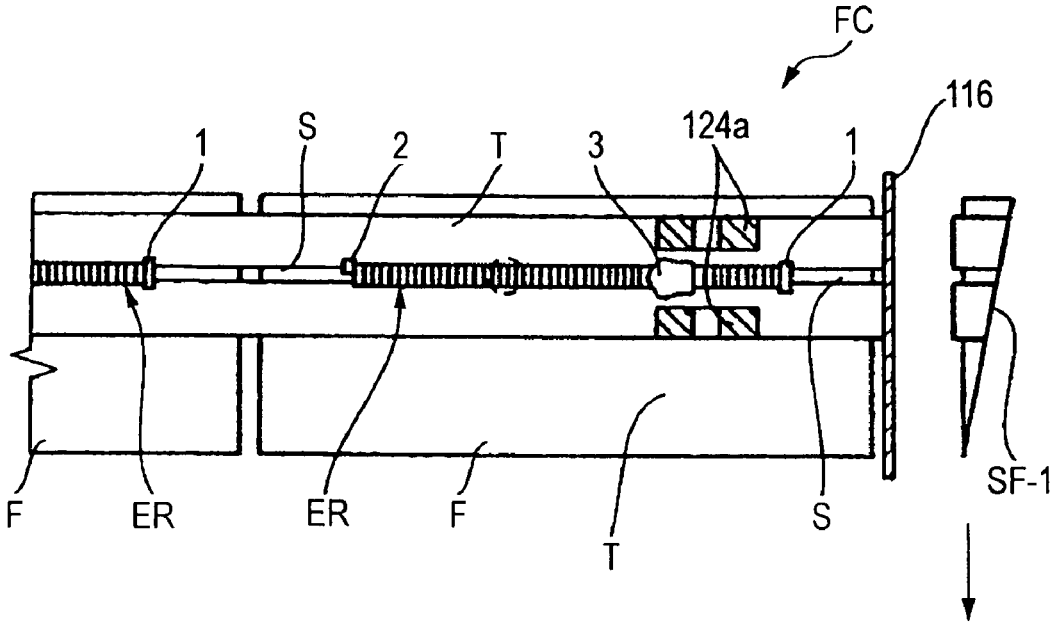
FIG. 12 is a top view showing a state in cutting to remove the uncut end by the same cutting blade.

Here, in order to cut to remove an uncut portion SF-1 of the rear end portion of the slide fastener SF produced by cutting this time, as shown in FIG. 11, the fastener chain FC attached with the fly is moved forward by a length of the uncut portion SF-1. When the forward moving is finished, the feed roller pair 124 is stopped to be driven. The chain cutting cylinder 115 is operated, and the interval portion S is cut to cross orthogonally the interval portion S of the fastener chain FC attached with the fly by the chain cutting blade 116. The cut chip produced by cutting to separate the uncut portion SF-1 is dropped to the cut chip discharge portion 112*d* provided at the lower portion of the chain inserting hole 112, and discharged from the opening to outside by passing the cut chip discharging path 112*d*-1 by compressed air blown out from the air blow out port 112*d*-2.

On the other hand, the slide fastener SF attached with the fly sliding down by the self weight on the fastener slide down portion 130 as described above is automatically introduced into the closed bottom portions 141*a*, 142*a* in the box-like shape of the left and right pivoting members 141, 142 at the fastener receiving portion 140 shown in FIG. 5. Here, when the pivoting member operating cylinder 143 is operated in the length elongating direction, and the connector 144 fixed to the rod end is moved down, the shaft portions 141*d*, 142*d* projected from the left and right operating rods 141*c*, 142*c* inserted into the pair of left and right shaft portion supporting long holes 144*a* formed at the connector 144 are moved down and slidingly moved to the left and to the right in the shaft portion supporting long holes 144*a*. The left and right pivoting members 141, 142 are pivoted centering on the left and right support shafts 132 projected from the frame 131 in the gate shape forward, and the left and right pivoting members 141, 142 indicated by imaginary lines in FIG. 6 are opened to positions indicated by bold lines in the drawing.

When the left and right pivoting members 141, 142 are opened in this way, the slide fastener SF attached with the fly placed on the bottom portions 141*a*, 142*a* is dropped by the self weight from the opening and is contained in the fastener containing chamber 151 of the fastener containing portion 150 at standby on the lower side. At this occasion, by making the inclination angle β of the fastener receiving faces of the bottom portions 141*a*, 142*a* of the pivoting members 141, 142 more gradual than the inclination angle α of the fastener slide down portion 130, the slide fastener SF attached with the fly approaches the horizontal bottom face of the fastener containing chamber 151 and therefore, an attitude of dropping the slide fastener attached with the fly dropped from the pivoting members 141, 142 is stabilized and is dropped regularly to the fastener containing chamber 151.

Although not illustrated, a number of sheets of the slide fasteners attached with the fly dropped from the pivoting members 141, 142 is counted by a counter, when a number of sheets of containing the slide fasteners SF attached with the fly contained in the single fastener containing chamber 151 reaches a predetermined number, the fastener containing portion 150 is intermittently rotated centering on the stay 101 and the vacant fastener containing chamber 151 at a next position is moved to right below the pivoting members 141, 142.

Figure 13:
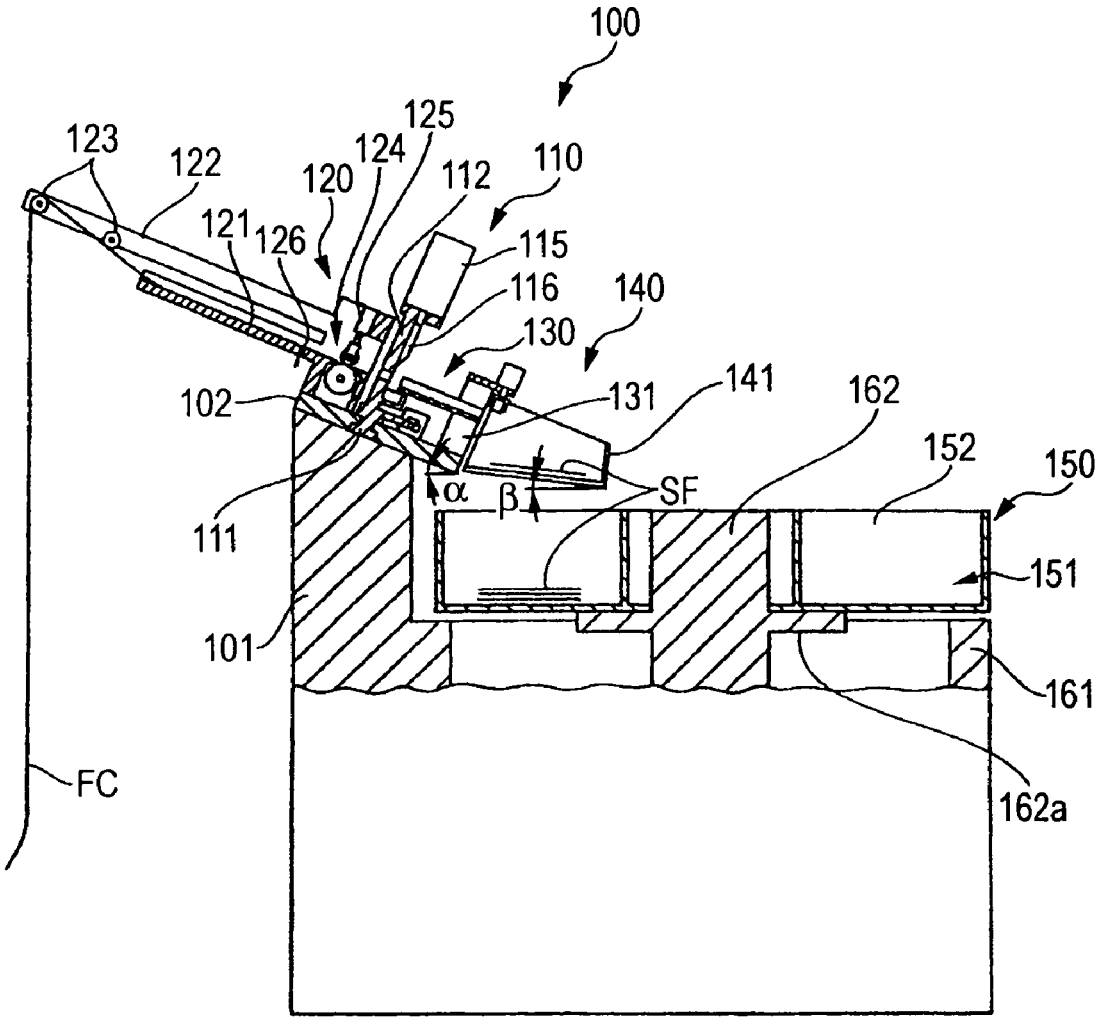
FIG. 13 is a partially cut away side view showing the whole constitution of a successive manufacturing apparatus of a slide fastener according to a second embodiment of the invention.
Figure 14:
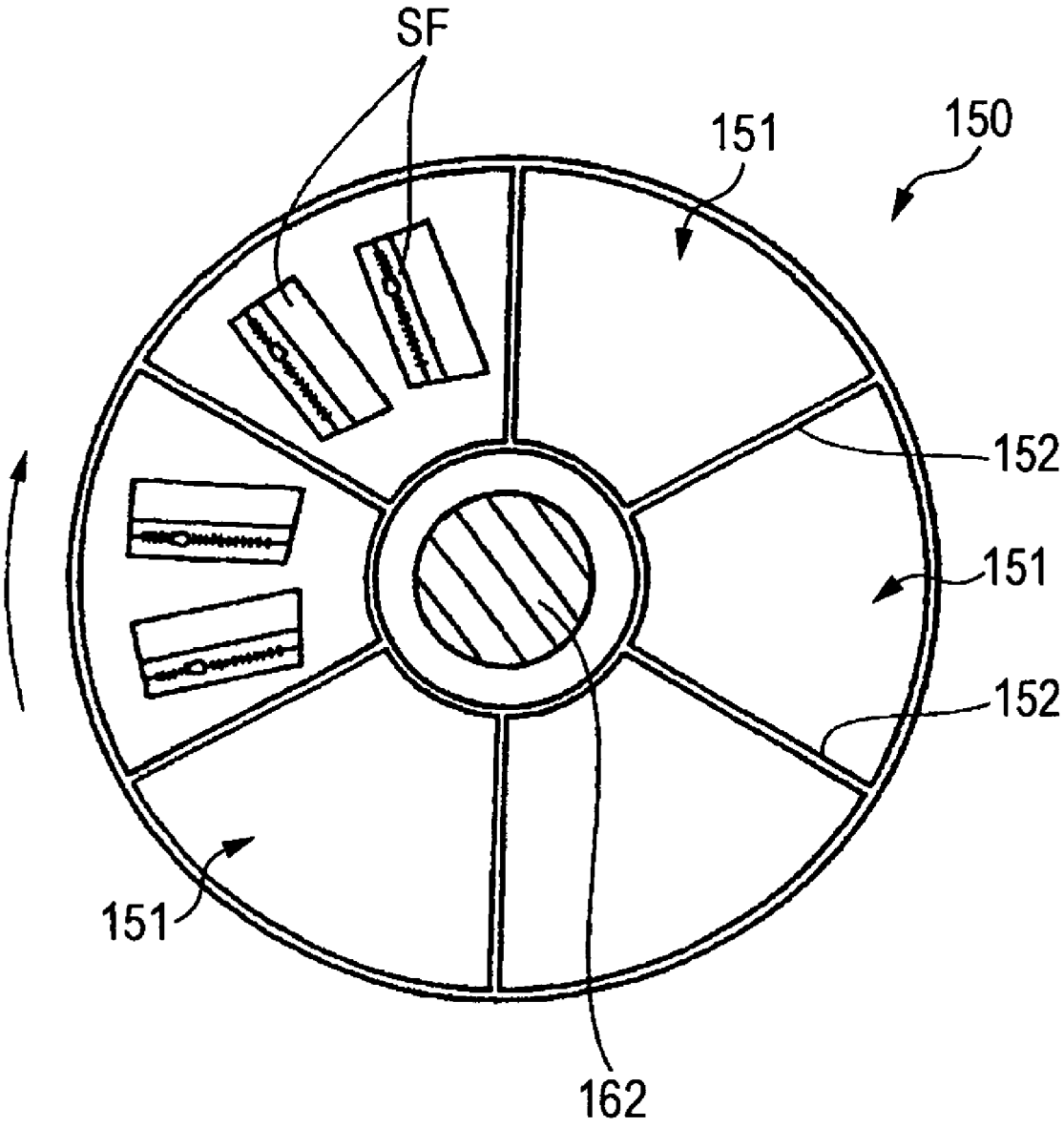
FIG. 14 is a top view of a fastener containing portion of the successive manufacturing apparatus of the slide fastener.

FIG. 13 and FIG. 14 show a second embodiment of the invention. In the first embodiment, the fastener containing portion 151 is intermittently rotated on the flange 101*c* formed integrally with the middle of the stay 101, and the slide fastener SF attached with the fly is contained in the respective fastener containing chambers 151. According to the second embodiment, the fastener containing portion 150 is not supported by the stay 101 but there is provided a frame 161 in a cylindrical shape extended from the stay 101 to a side of a portion of dropping the slide fastener SF attached with the fly. A rotating shaft 162 for rotatably supporting the fastener containing chamber 151 is rotatably erected at a center of a hollow portion of the frame 161. A flange 162*a* is integrally formed with the rotating shaft 162 and the fastener containing portion 150 is mounted to be fixed on the flange 162*a*. Here, the stay 101 is disposed on an outer peripheral side of the fastener containing portion 150, and the fastener containing chamber 151 is disposed right below the left and right pivoting members 141, 142.

The second embodiment is not changed from the first embodiment in that the board 102 is inclinedly supported, and other constitution is substantially the same as that of the first embodiment. However, as shown in FIG. 14, the fastener containing chambers 151 according to the embodiment has six chambers partitioned by the partitions 152 at respective 60°. The fastener containing portion 150 is stopped after being rotated by 30°, a predetermined number of sheets of the slide fasteners attached with the fly are contained at a region of the single fastener containing chamber 151 contiguous to the partition 152 on a side in a rotational direction, thereafter, the fastener containing portion 150 is stopped after being rotated by 30°, and a predetermined number of sheets of the slide fasteners attached with the fly are contained at a region of the fastener containing chamber 151 contiguous to the partition 152 on a side opposed to the rotational direction. That is, two rows of the required numbers of sheets of the slide fasteners attached with the fly are contained at a single chamber of the fastener containing chamber 151. By repeating the procedure, the slide fasteners attached with the fly are contained successively in all of the fastener containing chambers 151. In order to intermittently rotating the fastener containing portion 151, a rotational driving portion, not illustrated, for driving the rotating shaft 162 is installed at the hollow portion of the frame 161.

As can be understood from the above-described explanation, the successive manufacturing apparatus of the slide fastener according to the invention is applicable to all of the fastener chains from the fastener chain attached with the fly to a normal fastener chain which is not attached with the fly as described above. Also the cutting angle in cutting the interval portion can arbitrarily be adjusted from 0° to 15°. Naturally, when needed, a range of adjusting the cutting angle can further be changed.

The invention is not limited to the above-described embodiments but various changes and modifications of its components may be made without departing from the scope of the present invention. For example, the fastener receiving portion 140 may be eliminated so that the fastener containing portion 150 is placed on the lower side of a fastener discharge end of the chain transfer path 121.

What is claimed is:

1. A slide fastener manufacturing apparatus for manufacturing a slide fastener by cutting a long fastener chain, alternately having in a longitudinal direction thereof a pair of element rows meshing with each other and an interval portion lacking the element row, at a predetermined position of the interval portion, the apparatus comprising:

a chain transfer path inclined downward for transferring the fastener chain;

a chain cutting portion disposed at a middle of the transfer path;

a feed portion of the fastener chain disposed on an upstream side of the chain cutting portion of the chain transfer path;

a control portion for stopping to transfer the fastener chain by the feed portion and operating the chain cutting portion; and a pivoting section which pivots the chain cutting portion by a predetermined angle on the chain transfer path around an axis line orthogonal to the transfer path.

2. The slide fastener manufacturing apparatus according to claim 1, further comprising:

a detecting section which detects an end portion of the interval portion, the detecting section disposed on the chain transfer path of the fastener chain; and a length measuring section which starts measuring a length of transferring the fastener chain upon reception of a detecting signal of the detecting section.

3. The slide fastener manufacturing apparatus according to claim 1, further comprising:

a fastener receiving and discharging portion disposed on a lower side of a fastener discharge end of the chain transfer path and including a bottom portion on which the slide fastener is placed; and an opening and closing section which opens and closes the bottom portion.

4. The slide fastener manufacturing apparatus according to claim 1, further comprising:

a fastener containing portion disposed on a lower side of a fastener discharge end of the chain transfer path.

5. The slide fastener manufacturing apparatus according to claim 3, wherein the bottom portion has an inclination angle more gradual than an inclination angle of the transfer path.

6. The slide fastener manufacturing apparatus according to claim 4, further comprising:

a fastener receiving and discharging portion disposed on a lower side of the fastener discharge end of the chain transfer path and including a bottom portion on which the slide fastener is placed; and an opening and closing section which opens and closes the bottom portion, wherein the fastener containing portion is disposed on a lower side of the bottom portion, in which the slide fastener fallen by the self weight is contained when the bottom portion is opened.

7. The slide fastener manufacturing apparatus according to claim 6, wherein the fastener containing portion has a ring-like shape and includes a plurality of containing chambers formed by partitioning the containing portion in a peripheral direction.

8. The slide fastener manufacturing apparatus according to claim 1, wherein the chain transfer path includes an upstream side portion and a downstream side portion an inclination angle of which are substantially the same, and the a chain cutting portion is disposed between the upstream side portion and the downstream side portion.

* * * * *